US005479860A

United States Patent [19]

Ellis

[11] Patent Number: 5,479,860

[45] Date of Patent: Jan. 2, 1996

[54] SHAPED-CHARGE WITH SIMULTANEOUS MULTI-POINT INITIATION OF EXPLOSIVES

[75] Inventor: James Ellis, Houston, Tex.

[73] Assignee: Western Atlas International, Inc., Houston, Tex.

[21] Appl. No.: 340,750

[22] Filed: Nov. 16, 1994

Related U.S. Application Data

[63] Continuation-in-part of Ser. No. 268,791, Jun. 30, 1994, abandoned.

[51] Int. Cl.[6] ..... F42B 3/00; F42C 15/00

[52] U.S. Cl. ..... 102/313; 102/312; 102/310; 102/202.7; 102/202.8

[58] Field of Search ..... 102/312, 313, 102/201, 202.7, 202.8, 307, 309, 310

[56] References Cited

U.S. PATENT DOCUMENTS

| | | | |
|---|---|---|---|
| 3,013,491 | 12/1961 | Poulter | 102/20 |
| 4,018,293 | 4/1977 | Keller | 175/4.5 |
| 4,762,067 | 8/1988 | Barker et al. | 102/313 |
| 4,860,654 | 8/1989 | Chawla et al. | 102/306 |
| 4,860,655 | 8/1989 | Chawla | 102/306 |
| 4,896,332 | 1/1990 | Wisotzki | 372/99 |
| 5,014,062 | 5/1991 | Schriner et al. | 342/68 |
| 5,080,016 | 1/1992 | Osher | 102/202.7 |
| 5,229,542 | 7/1993 | Bryan et al. | 102/491 |
| 5,317,973 | 6/1994 | Winaver et al. | 102/201 |
| 5,359,935 | 11/1994 | Willett | 102/307 |
| 5,370,053 | 12/1994 | Williams et al. | 102/202.5 |

*Primary Examiner*—Peter A. Nelson
*Attorney, Agent, or Firm*—Elizabeth W. Layman

[57] ABSTRACT

An apparatus for perforating an earth formation from a borehole having a housing, a detonator assembly, explosive material for producing the implosion forces and a metal liner of implosive geometry. The detonator assembly includes a predetermined pattern of precision electronic detonators based on exploding foil initiator, exploding bridge wire, spark gap or laser technology to simultaneously produce multiple initiation points of the explosive material for enhancing the implosion forces.

5 Claims, 7 Drawing Sheets

SHAPED-CHARGE WITH SIMULTANEOUS MULTI-POINT INITIATION OF EXPLOSIVES

This is a continuation-in-part of U.S. application Ser. No. 07/268,791 filed on Jun. 30, 1994, now abandoned.

FIELD OF THE INVENTION

This invention is related to the field of oil and gas well completions and more specifically to an apparatus for increasing the force of an explosive charge to provide deeper and/or larger-diameter penetration holes in the earth formation surrounding the well.

DESCRIPTION OF THE RELATED ART

Completed oil and gas wells with steel casing cemented into the borehole are brought into production by perforating the well casing, cement and surrounding earth formation to create flow passages for the oil and gas from the producing zones into the casing. One typical method utilizes a perforating gun, in a form commonly referred to in the industry as "shaped-charges", to detonate explosives of high energy creating holes in the well casing and surrounding formation.

The perforating gun typically is lowered into the well casing via a wireline from the surface. The wireline may connect the perforating gun to a surface control apparatus to enable the operator to remotely trigger the gun. The shaped-charge in the gun typically comprises a metal case with a cavity filled with high explosives and a liner made of copper or other similar material. The shaped-charge commonly is initiated by means of an electric detonator and attached detonating cord. When the detonator is fired, it initiates the detonating cord (primary explosive) which in turn initiates the high explosives (secondary explosive) in the shaped-charge creating detonation waves.

The detonation waves, originating at the initiation point within the shaped-charge, travel along the axis of the shaped-charge through the apex of the liner and then continue toward the base (throat) of the liner. The enormous pressure exerted by the detonation results in the collapse (implosion) of the top of the liner inwardly toward the axis of the shaped-charge. This implosion of the liner creates a jet of metal particles which is projected along the axis of the liner away from the apex, through the steel casing and surrounding cement, and into the formation thereby forming a flow passage for the oil or gas.

The performance of a shaped-charge is directly dependent on the magnitude of the forces created by the explosives. Because the casing in which the perforating gun must fit has a relatively small diameter, the size of the shaped-charge is limited. This limits the quantity of explosive that can be used which in turn limits the maximum performance.

Although the shaped-charge of the prior art has many advantages, it also has limitations. In general, this type of charge is extremely sensitive to variations in the dimensions and configuration of its components. Even minor alterations in configuration and dimensions can cause a drastic reduction in the effectiveness of the device.

Multiple-point initiation of the explosives improves the performance of the shaped-charge by increasing the magnitude of the created forces to produce wider and longer holes. If the multiple points are not initiated almost simultaneously, however, the performance may be degraded. The wavefronts created by differently-timed explosions result in interference between the wavefronts. The interference may result in irregularly shaped penetration holes which are shallower and/or narrower in diameter than regularly shaped holes.

Standard electric detonators are not satisfactory for multiple-point initiation of high explosives. The individual firing times of this type of detonators can vary by milliseconds. A typical explosive wavefront from a secondary explosive travels at a velocity in excess of 6 meters/millisecond (RDX is approximately 8 meters/millisecond and HNS is more than 6 meters/millisecond). Therefore, even minor discrepancies in the firing times of the detonators may distort the effect of the charge.

Examples of prior art using shaped-charges with multiple initiation points are described in U.S. Pat. No. 4,829,901 issued to Yates ("the Yates patent") and in U.S. Pat. No. 4,860,655 issued to Chawla ("the Chawla patent"), incorporated herein by reference. The Yates patent discloses a multi-point discharge insert which channels shock waves from the primer cord to multiple points in the explosive material. The insert contains multiple channels filled with primary explosives and provides paths for the waves initiated by the primer cord which indirectly activate the secondary explosives. Any distortion of the waves as they travel though the channels, however, adversely affects the timing of the indirect activation of the secondary explosives. Distortions can be caused by variations in the surface of the channels, the packing of the explosives in the channels and/or the lengths of the channels. Furthermore, the number of multiple initiation points is limited to the number of channels contained in the insert. This limitation and the possible wave distortion may inhibit the magnitude of the force of the shaped-charge.

The Chawla patent teaches an apparatus and method for penetrating earth formations using an implosion shaped-charge perforator. To achieve the desired implosion forces, Chawla utilizes a series of detonations to explode (primary explosion) a throw plate located within the shaped-charge. The resultant particles from the exploding throw plate are focused through a gap to impact the secondary explosives at multiple points. Although the Chawla patent teaches a shaped-charge with more initiation points than probably can be achieved with the Yates patent, the pattern of the multiple explosions in the Chawla patent are random and the percentage of the surface of the secondary explosives exposed to the particles is limited by the dimensions of the gap which may limit the force of the shaped-charge.

There has been a long and unfulfilled need to provide an explosive apparatus that can be easily produced with varying parameters to predictably provide explosive forces of the magnitude required for the various penetration results that are desired. The present multi-point initiation invention addresses the above-noted problems and provides a shaped-charge with enhanced explosive forces.

SUMMARY OF THE INVENTION

The present invention is an apparatus which utilizes a plurality of precision electronic detonators to provide enhanced penetration from a well borehole into an earth formation. Embodiments of the apparatus include a shaped-charge with a plurality of detonators (based on exploding foil initiator, exploding bridge wire, spark gap or laser technologies) positioned in a detonator assembly (adapted to fit between the explosive material and the inner surface of the case of the shaped-charge) in a pattern determined by the magnitude of the explosive force needed to create a penetration hole with a predetermined diameter, depth and shape. The detonators are activated approximately simultaneously by an energy pulse and directly produce simultaneous explosions at multiple points on the surface of the explosive material. The direct, simultaneous explosions in a pre-determined pattern enhance the force of the jet stream, formed by the implosion of the liner of the shaped-charge, which penetrates the formation creating the desired passageway from the borehole into the formation.

Examples of the more important features of the invention thus have been summarized rather broadly in order that the detailed description of the preferred embodiments that follows may be better understood, and in order that the contributions to the art may be appreciated. Additional features of the invention will be described hereinafter and will form the subject of the claims appended hereto.

BRIEF DESCRIPTION OF THE DRAWINGS

For a detailed understanding of the present invention, references should be made to the detailed description of the preferred embodiments, taken in conjunction with the accompanying drawings, in which the like elements have been given like numerals and wherein.

DETAILED DESCRIPTION OF THE PREFERRED EMBODIMENTS

Figure 1:
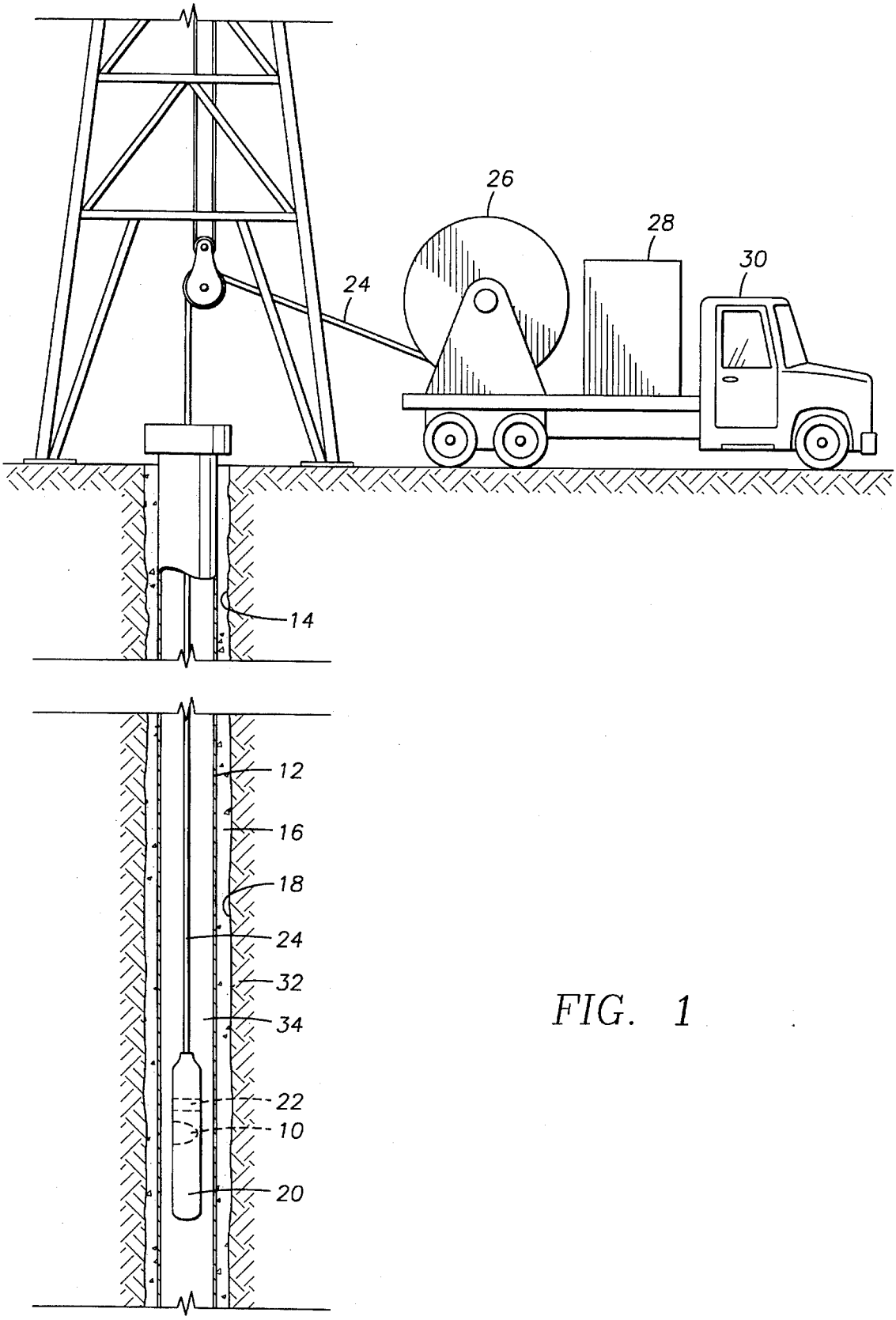
FIG. 1 is a diagram showing the invention deployed in a borehole.

FIG. 1 illustrates a typical equipment configuration at a well site using a shaped-charge 10 of the present invention. A steel casing 12 is put into a borehole 14 and held in place with cement 16 which fills the void between the wall 18 of the borehole 14 and the steel casing 12 and bonds to the steel casing 12. The shaped-charge 10 is deployed in a perforating gun 20 and connected to an energy source 22 contained within the perforating gun 20.

The perforating gun 20 usually is lowered into the borehole 14 on a wireline 24 via a winch 26 and connected to surface controls 28 on a service truck 30. The surface controls 28 include a power source which is connected to the energy source 22 in the perforating gun 20 through conductors in the wireline 24. The perforating gun 20 is positioned in the borehole 14 adjacent to a producing zone of interest in a formation 32. The shaped-charges 10 are sealed within the perforating gun 20 to prevent well fluids 34 and other contaminants from penetrating the shaped-charges 10.

Figure 2:
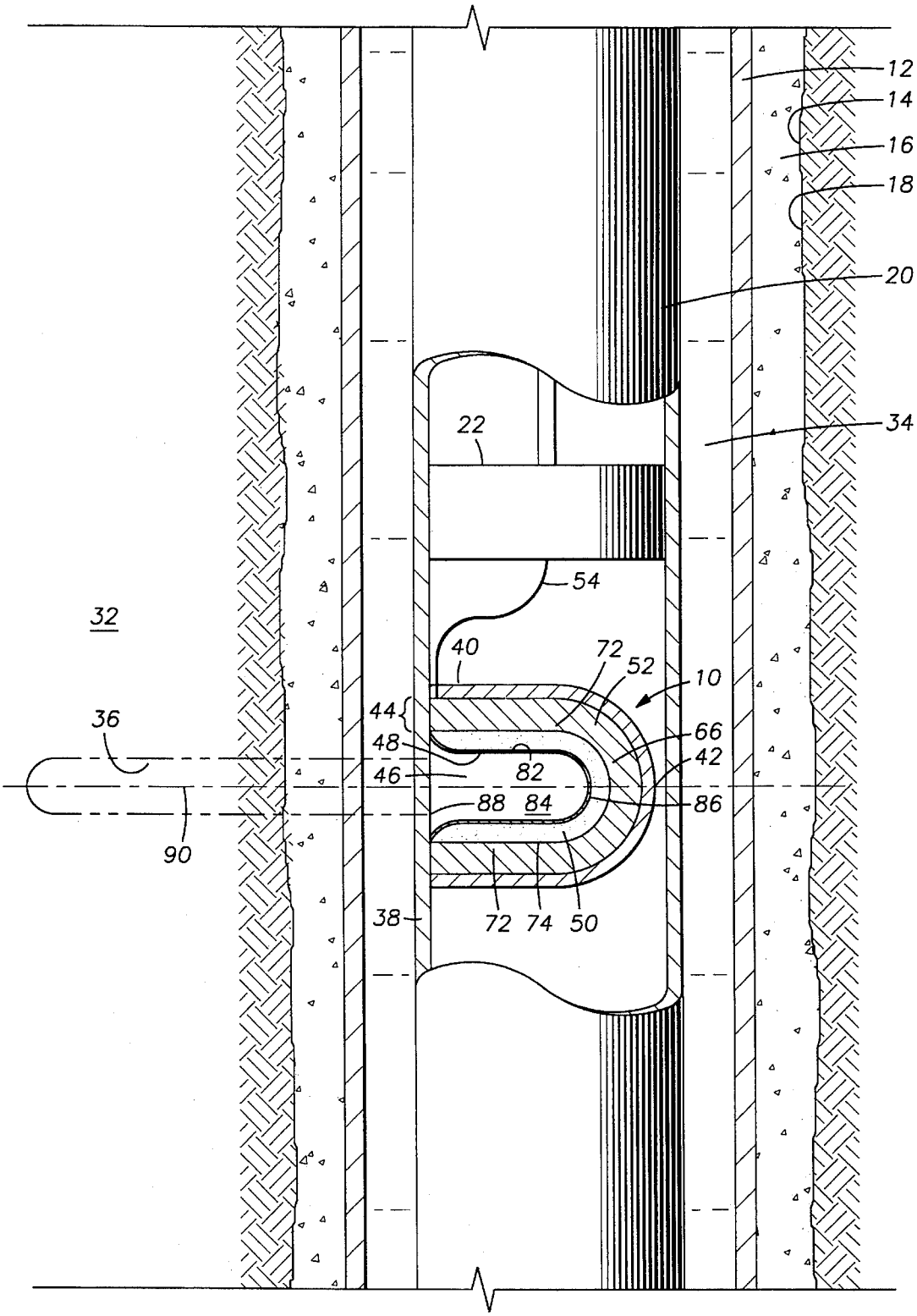
FIG. 2 shows a cross-sectional view of the invention deployed in a perforating gun and the resultant passageway into the formation.

As illustrated in FIG. 2, the explosion of the shaped-charge 10 results in the formation of a passageway 36 between the inside of the steel casing 12 and the producing zone of the formation 32. The passageway 36 traverses through a wall 38 of the perforating gun 20, the steel casing 12 and the cement 16 into the formation 32.

Figure 3:
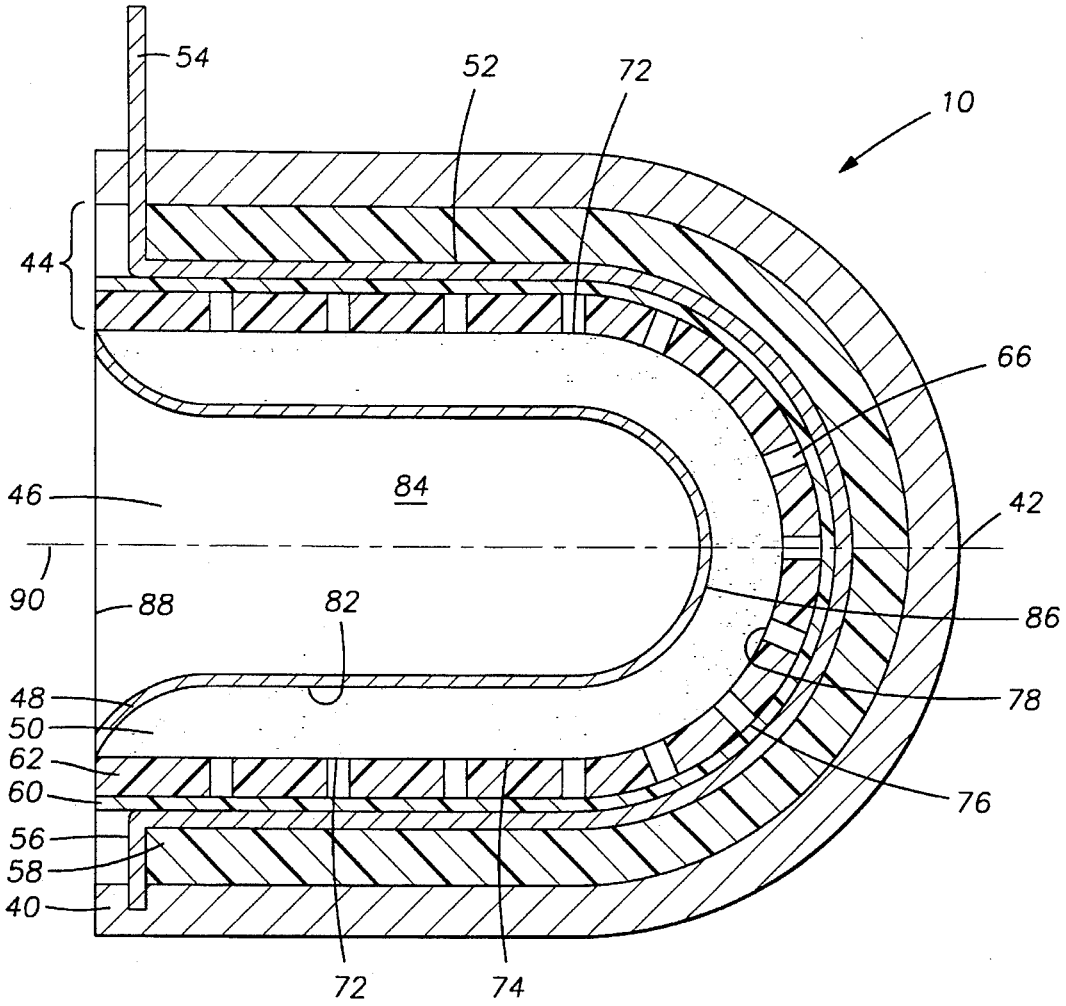
FIG. 3 is an enlarged, cross-sectional view of the first of four preferred embodiments (exploding foil initiator, exploding bridge wire, spark gap and laser).

As shown in the enlarged cross-sectional view in FIG. 3, the shaped-charge 10 is housed in a housing 40 to protect the inner components of the shaped-charge 10 during handling and storage and to provide a mass against which the explosion can react such that the forces of the explosion will be directed opposite the apex 42 of the housing 40. One of the preferred materials for the housing 40 is steel. Other materials can also be used. Steel is by way of example and is not meant to limit the scope of the invention.

Figure 5A:
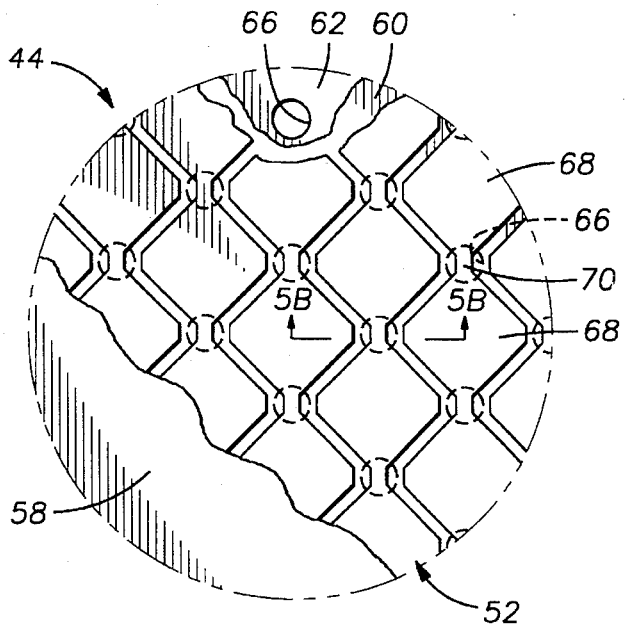
FIG. 5A, 6A and 7A are exploded, cut-away top views
Figure 5C:
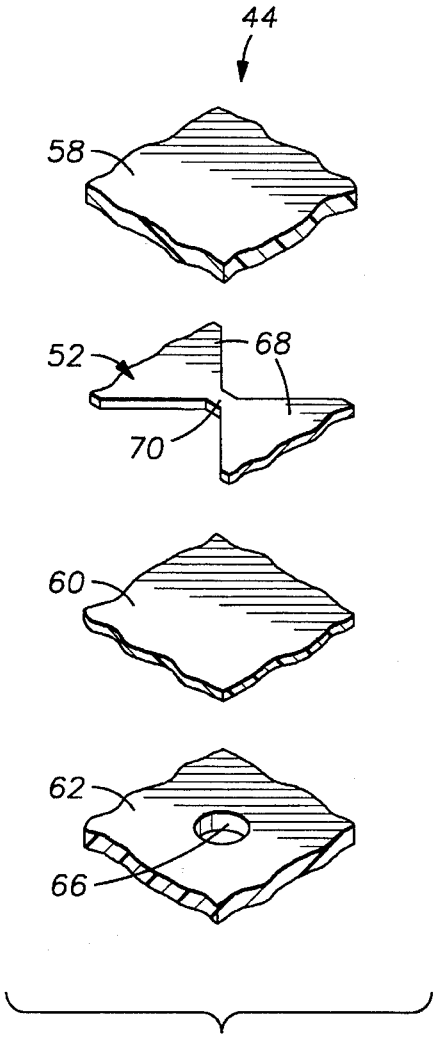
FIG. 5C, 6C, 7C and 8C are exploded, perspective views of the layers of the detonator assembly of the four preferred embodiments of the invention, respectively.
Figure 5B:
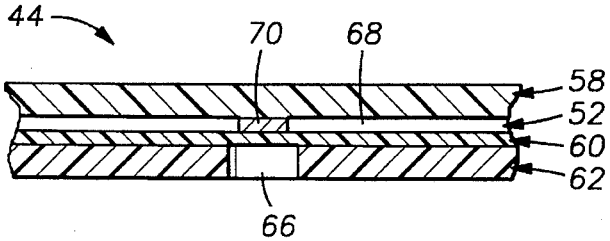
FIG. 5B, 6B, 7B and 8B are cross-sectional views along lines 5B—5B, 6B—6B, 7B—7B and 8B—8B of FIG. 5A, 6A, 7A and 8A, respectively.

As shown in FIG. 2, a detonator assembly 44 of the preferred embodiments is fitted into a cavity 46 of the housing 40. A liner 48 is positioned contiguous to explosive material 50 to compress the explosive material 50 against the detonator assembly 44. The detonator assembly 44 is illustrated in a set of three views (A–C) for each of the tour preferred embodiments: FIG. 5A–C (exploding foil initiator), FIG. 6A–C (exploding bridge wire), FIG. 7A–C (spark gap) and FIG. 8A–C (laser).

The first view (A) of each set is an exploded view of a portion of the detonator assembly 44 illustrating a detonator pattern for the embodiment; the second view (B) is a partial, cross-sectional view showing the layers of the detonator assembly 44 of the embodiment and the third view (C) is an exploded, perspective view of the layers of the detonator assembly 44 for the corresponding preferred embodiment. Each of the three views for each of the preferred embodiments is discussed in detail below.

Exploding Foil Initiator (EFI) Embodiment

The detonator assembly 44 of the EFI embodiment is made of a non-electrically-conductive material and, as shown in FIG. 5A–C, contains a plurality of detonators 52 connected in series to the energy source 22 (FIG. 2) such that the detonators 52 detonate approximately simultaneously when the power is applied. This preferred embodiment uses detonators 52 that are based on exploding foil initiator (EFI) technology because of the ability of the EFIs to be initiated simultaneously and to directly initiate secondary explosives such as RDX (cyclotrimethylenetrinitramine) and HNS (hexanitro stilbene). Secondary explosives are less sensitive than primary explosives and generally require shock wave energy from a primary explosive for detonation. The detonators 52 provide the necessary shock wave energy for initiation of secondary explosives. Other detonators using exploding bridge wire, spark gap and laser technology also can be used and are discussed below. EFIs are meant by way of example and are not meant to limit the invention.

Different types of perforation holes are needed for different applications. In some applications, the preferred hole is narrow and long. In others, a wider hole with less depth is preferred. Some of these characteristics of the passageway 36 (FIG. 2) can be varied by changing the components of the shaped-charge 10 as discussed below. The detonation pattern (one of which is illustrated in FIG. 5A), formed by the placement of the detonators 52 in the detonator assembly 44 of the shaped-charge 10, is also one of the primary determinants of the characteristics (diameter, depth, shape) of the resultant passageway 36 into the formation 32.

Figure 4:
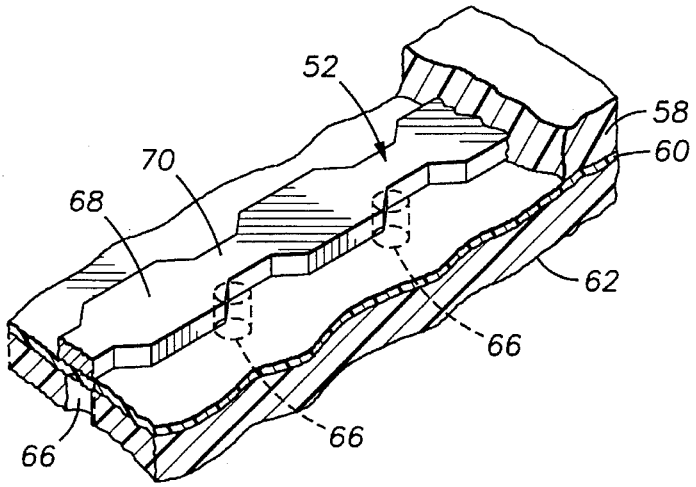
FIG. 4 is a perspective, cross-sectional view of the detonator assembly of the first embodiment.

The detonators 52 of the EFI embodiment are connected in series (FIG. 4 and 5A) to form a part of an electrical circuit. One end of the circuit is connected via a power line 54 (FIG. 2) to the energy source 22 and the other end is connected via a ground line 56 (FIG. 3) to the housing 40 to complete the electrical circuit. EFI detonators need high voltage and a high current pulse with a fast rise time for efficient operation. The energy source 22 in the preferred embodiment, therefore, is located near the detonators 52.

The detonator assembly 44 (FIG. 5A–C) can be made by any method that provides the proper layering of the components of the detonator assembly 44 and the proper shape such that the detonator assembly 44 fits into the cavity 46 of the housing 40. As shown in FIG. 4 and 5A–C, the detonator assembly 44 of the EFI embodiment is comprised of detonators 52 etched into the bottom surface of a first insulating layer 58, a thin insulating coat 60 applied beneath the detonators 52 and a second insulating layer 62 located beneath and contiguous to the insulating coat 60. The second insulating layer 62 contains cylindrical channels (barrels) 66 which extend completely through the second insulating layer 62. The electrically-conductive detonators 52 are comprised of foils 68 connected in series through narrow necks 70.

A high-current firing pulse from the activated energy source 22 (FIG. 2) causes vaporization of the necks 70 in approximately 100 nanoseconds. The vaporization of the necks 70 causes small disks (not shown) from the thin insulating coat 60 to shear off from the insulating coat 60, accelerate through the barrels 66 (FIG. 5B) in the second insulating layer 62 and impact initiation points 72 (FIG. 2) on a surface 74 of explosive material 50. The preferred embodiment uses RDX, HMX or HNS explosive material. Other materials with similar explosive characteristics can also be used. RDX, HMX and HNS are meant for example only and are not meant to limit the scope of the invention.

The small disks which are broken loose by the vaporizing necks 70 are the portions of the thin insulating coat 60 (FIG. 4 and 5B–C) that are located between top ends 76 of the barrels 66 and the necks 70. The initiation points 72 (FIG. 2) are located on the surface 74 of explosive material 50 at the bottom ends 78 of the barrels 66. In the preferred embodiment, the thin insulating coat 60 is made of a plastic such as Mylar. Other materials with similar insulating and shear properties can also be used. Mylar is included as an example only and is not meant to limit the scope of the invention.

Because the high-current firing pulse travels through the necks 70 in the electrical circuit almost simultaneously, the necks 70 explode at approximately the same time resulting in simultaneous projection of the disks through the barrels 66 to impact the initiation points 72 causing explosive material 50 to detonate with enhanced force due to the simultaneous detonations.

As shown in FIG. 3, the liner 48 is positioned contiguous to and compressed against explosive material 50 such that points on an explosive surface 82 of the liner 48 are perpendicularly equidistant from the initiation points 72 of explosive material 50. The liner 48 in the preferred embodiment is made of a soft, dense metal, such as copper or a copper alloy. Other materials can also be used. Copper and copper alloy are included by way of example and are not meant to limit the scope of the invention. The force of the explosion of explosive material 50, which is one of the parameters in determining passageway characteristics, can be varied by changing the quantity and positions of the initiation points 72 by repositioning the corresponding necks 70 and barrels 66.

The effectiveness of the penetration also is directly influenced by the shape of a cavity 84 (FIG. 3), formed by the liner 48, and the distance between an end 86 of the liner 48 and a throat 88 of the liner 48, as discussed below. The angle and radius of the end 86 of the liner 48 are other factors in determining the size of the entry hole and the length of the penetration.

The energy source 22 (FIG. 1) in the preferred embodiment is activated from the surface controls 28 through the wireline 24. Other activation means can be used. Surface activation is meant by way of example and is not intended to limit the scope of the invention. Activation of the energy source 22 results in transmission of electrical current (or laser energy for the laser embodiment), with the necessary rise time and voltage, to explode the necks 70 in such a manner as to cause detonation of multiple initiation points 72 on the explosive material 50 simultaneously causing the liner 48 to implode.

The shape of the components of the detonator assembly 44, the symmetry between the surface 74 of explosive material 50 and the explosive surface 82 of the liner 48 and the shape of the liner 48 establish the shape of the wave form (not shown) generated by the explosions. The detonation wave front propagates through explosive material 50 and impinges on the liner 48. Tremendous pressures start to collapse the liner 48 on the axis 90 of the liner 48. Because the pressures are far beyond the yield strength of the metal used in the liner 48, the metal acts as a fluid. As the liner material converges on the axis 90, the material forms a jet stream (not shown) which moves forward towards the targeted area of the formation 32. Some of the material on the explosive surface 82 of the liner 48 may move at a slower velocity forming a carrot or slug (not shown) which follows behind the jet stream.

One of the factors affecting the formation and resulting effectiveness of the jet stream is the distance attained by the leading edge of the jet stream prior to encountering the first obstacle. This "standoff distance" is the distance between the end 86 of the liner 48 and the wall 38 of the perforating gun 20 (FIG. 2). Within certain limits, the length of the jet stream, and the created pressure, increases with the length of the standoff distance. The jet stream extends to its fullest length when the jet stream reaches the throat 88 of the liner 48 which is adjacent to the wall 38 of the perforating gun 20. At that point, the material in the liner 48 has been injected either into the jet stream or the slug.

The jet stream produces a pressure well beyond the yield strength of the metal, cement and rock obstacles that the jet stream encounters. This tremendous pressure allows the jet stream to pierce through several obstacles, such as the wall 38 of the perforating gun 20, the well fluids 34, the steel casing 12, the cement 16 and the wall of the borehole 18, to enter the formation 32. The diameter of the entry hole, the depth of penetration and the shape of the passageway 36 are determined by the force of the jet stream which is determined by the selected pattern (placement and quantity) of the detonators 52 in the detonator assembly 44 of the shaped-charge 10.

This description of the EFI embodiment also describes the other three preferred embodiments (exploding bridge wire, spark gap and laser) except for the differences in the components of the detonator assembly 44 of each embodiment which are described below.

Exploding Bridge Wire (EBW) Embodiment

Figure 6A:
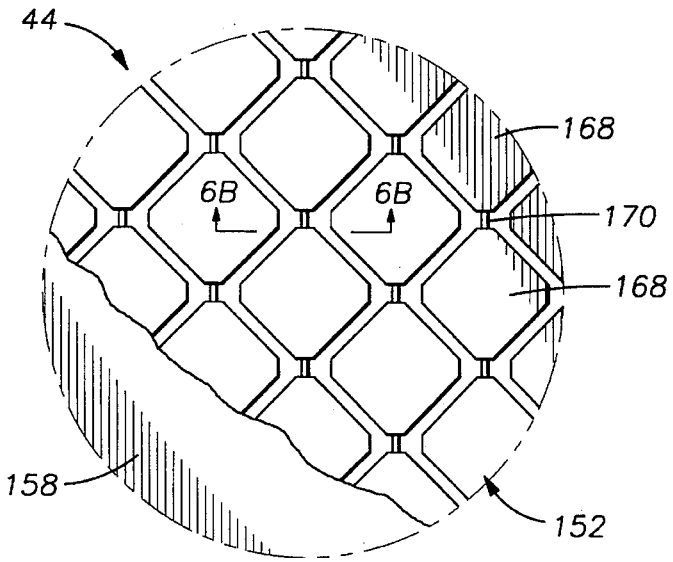
Figure 6C:
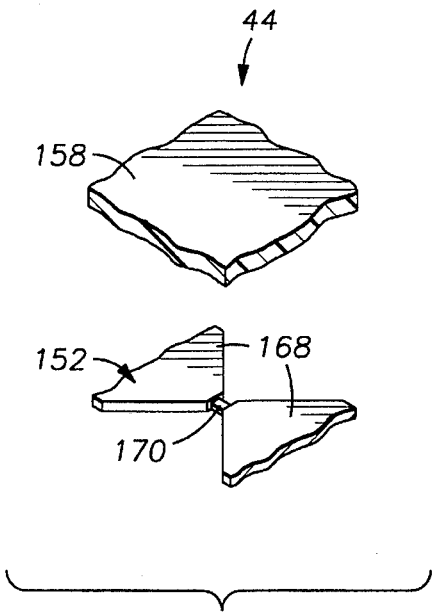
Figure 6B:
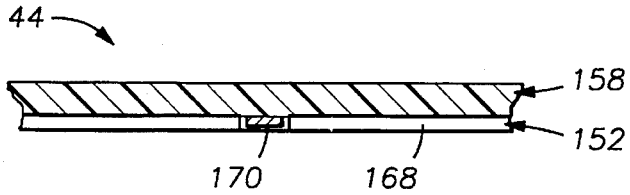

A second embodiment, based on exploding bridge wire (EBW) technology, is illustrated in FIG. 6A–C. The detonator assembly 44 contains an electrically-insulated layer 158 and a plurality of electrically-conductive foils 168 connected in series with bridge wires 170 which are etched into the insulated layer 158.

The pattern of the bridge wires 170 and conductive foils 168 is such that the conductive foils 168 and connecting bridge wires 170 can be considered as a single, ribbon-shaped detonator 152 that weaves back and forth across the inner surface of the insulated layer 158. One end of the detonator ribbon 152 is terminated (not shown) in the ground line (similar to the ground line 56 for the EFI embodiment as shown in FIG. 3) which is connected to the housing 40 of the shaped-charge 10 as an electrical ground while the other end of the detonator ribbon 152 is connected (not shown) via the power line 54 (FIG. 2) to the energy source 22 which is capable of providing a fast-rising, high-voltage, high-current pulse.

When such a pulse is applied to the detonator ribbon 152 (FIG. 6A–C), the bridge wires 170 explode approximately simultaneously. The energy expended by the explosion of each bridge wire 170 is sufficient to cause the secondary explosive material 50 (FIG. 2) which is pressed against the bridge wires 170 to be detonated high-order. Because of the close spacing of the bridge wires 170 (FIG. 6A), the effect of detonation at the multiple initiation points 72 (FIG. 2) is to closely approximate a surface initiation of the secondary explosive material 50, with beneficial effects on the perforating performance of the shaped charge 10.

Spark Gap Embodiment

Figure 7A:
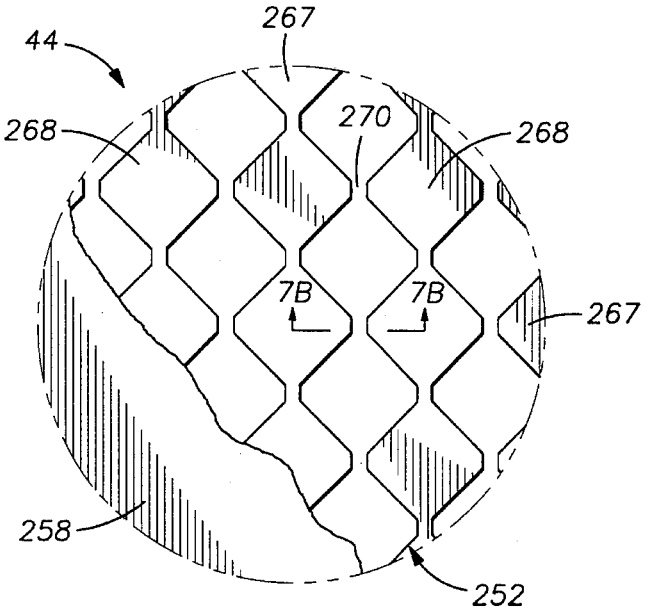
Figure 7C:
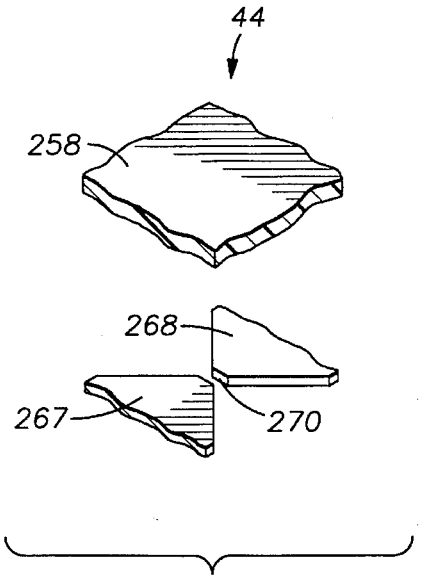
Figure 7B:
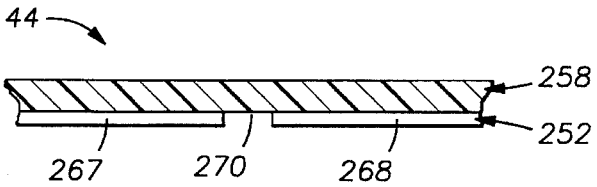

FIG. 7A–C illustrate a third embodiment of the present invention based on spark gap detonators. The detonator assembly 44 contains an electrically-insulating layer 258 and a detonator ribbon 252 comprised of two electrically-conductive ribbons (a grounded ribbon 267 and an energized ribbon 268) that weave back and forth across the inner surface of the insulating layer 258 in a pattern (FIG. 7A) that produces a large number of points at which the grounded ribbon 267 closely approaches the energized ribbon 268 but does not touch the energized ribbon 268. These closely-spaced points are defined as spark gaps 270.

One end of the grounded ribbon 267 is grounded (not shown) to the housing 40 of the shaped-charge 10 by the ground line 56 (similar to the EFI configuration shown in FIG. 2) and one end of the energized ribbon 268 is connected (not shown) via the power line 54 (FIG. 3) to the energy source 22. The second ends of the grounded ribbon 267 and the energized ribbon 268 are not terminated. When the energy source 22 is activated to produce a fast-rising, high-voltage, high-current pulse to the energized ribbon 268 (FIG. 7A–C), the voltage difference at spark gaps 270 is enough to cause electric sparks to arc simultaneously across each spark gap 270 to the grounded ribbon 267.

The energy imparted by each electric spark in the spark gaps 270 to the secondary explosive material 50 (FIG. 2) immediately adjacent to the detonator ribbon 252 of the detonator assembly 44 is sufficient to cause the explosive material 50 to be detonated high-order. Because of the close spacing (FIG. 7A) of the spark gaps 270, the multiple initiation points 72 (FIG. 2) act to closely approximate a surface initiation of the secondary explosive material 50 and enhance the perforating performance of the shaped charge 10.

Laser Embodiment

Figure 8A:
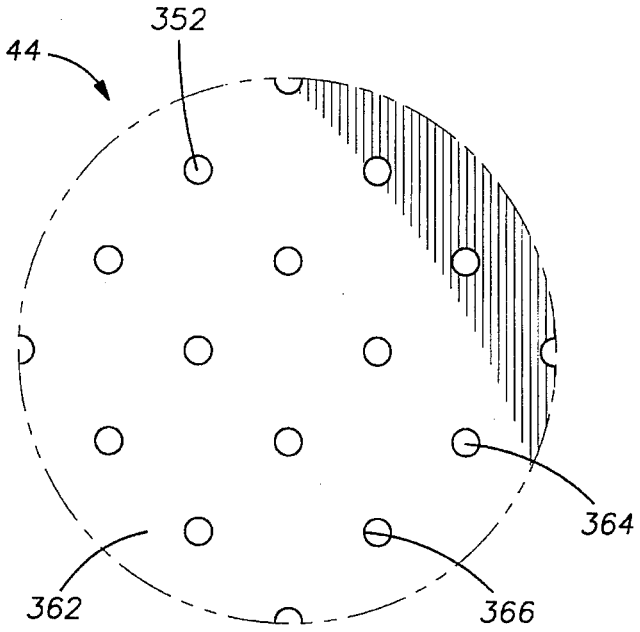
FIG. 8A is an exploded bottom view of the detonator assembly in the four preferred embodiments, respectively.
Figure 8C:
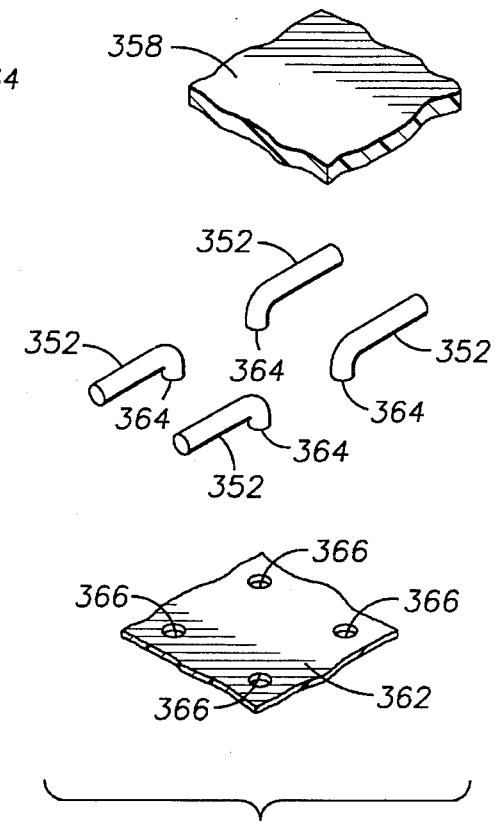
Figure 8B:
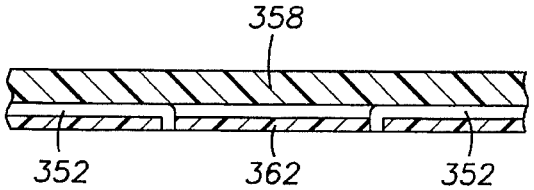

A fourth preferred embodiment, based on laser technology, is illustrated in FIG. 8A–C. The detonator assembly 44 contains a first insulating layer 358, a layer of optical fibers 352 and a second insulating layer 362. As shown in the bottom view of the detonator assembly 44 in FIG. 8A, detonating ends 364 of optical fibers 352 terminate in closely-spaced, cylindrical apertures 366 in the second insulating layer 362. Receiving ends (not shown) of optical fibers 352 are gathered together (not shown) at a single location outside the detonator assembly 44 of the laser embodiment and optically coupled via the power line 54 (FIG. 2) to the energy source 22 which is capable of providing a pulse of high energy laser light.

The secondary explosive material 50 which is pressed against the second insulating layer 362 of the detonator assembly 44 (FIG. 2) is doped with a material (not shown) such as graphite to absorb light energy more efficiently. When a high-energy laser pulse is applied from the energy source 22 to the gathered receiving ends (not shown) of the optical fibers 352, the optical fibers 352 instanteously transmit the energy out detonating ends 364 (FIG. 8A–C) of the optical fibers 352 to the closely-spaced initiation points 72 (FIG. 2) on the surface 74 of the secondary explosive material 50.

The energy absorbed by the explosive material 50 immediately adjacent to the detonating end 364 of each optical fiber 352 is sufficient to cause the explosive material 50 to be detonated high-order. Because of the close spacing of the detonating ends 364 of the optical fibers 352, the detonation at the multiple initiation points 72 reacts similarly to the EFI, EBW and spark gap embodiments to closely approximate a surface initiation of the secondary explosive material 50 resulting in the desired enhanced perforating performance of the shaped charge 10.

The foregoing description is directed to the four preferred embodiments of the present invention for the purpose of illustration and explanation. It will be apparent, however, to one skilled in the art that many modifications and changes to the embodiments set forth above are possible without departing from the scope of the invention. It is intended that the following claims be interpreted to embrace all such modifications and changes.

I claim:

1. An apparatus for perforating an earth formation from a borehole, said apparatus connected to an energy source and comprising:

(a) a housing adapted to be deployed within said borehole;

(b) a liner located within said housing;

(c) a detonator assembly located between said liner and said housing and comprising a plurality of detonators for producing approximately simultaneous detonation waves when activated by said energy source, where in said plurality of detonators is arranged in a predetermined pattern; and (d) explosive material located between said liner and said detonator assembly, said explosive material cooperating with such detonator assembly to activate, approximately simultaneously in response to said detonation waves, at a plurality of initiation points determined by the pattern of said plurality of detonators.

2. The apparatus of claim 1 wherein the detonators are exploding foil initiators.

3. The apparatus of claim 1 wherein the detonators are exploding bridge wire detonators.

4. The apparatus of claim 1 wherein the detonators are spark-gap detonators.

5. The apparatus of claim 1 wherein the detonators are laser detonators.

* * * * *